US008050616B2

(12) United States Patent
Suzuki

(10) Patent No.: US 8,050,616 B2
(45) Date of Patent: Nov. 1, 2011

(54) IMAGE FORMING APPARATUS

(75) Inventor: Tomoo Suzuki, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 455 days.

(21) Appl. No.: 11/713,500

(22) Filed: Mar. 2, 2007

(65) Prior Publication Data

US 2007/0280763 A1 Dec. 6, 2007

(30) Foreign Application Priority Data

May 30, 2006 (JP) ..... 2006-149481

(51) Int. Cl.
*G03G 15/00* (2006.01)

(52) U.S. Cl. ..... 399/395; 399/394

(58) Field of Classification Search ..... 399/395, 399/394

See application file for complete search history.

(56) References Cited

U.S. PATENT DOCUMENTS 4,941,021 A * 7/1990 Uchida et al. ..... 399/322
5,156,391 A 10/1992 Roller
5,543,909 A * 8/1996 Quesnel ..... 399/394
5,678,127 A * 10/1997 Suga ..... 399/45
5,681,036 A * 10/1997 Wakahara et al. ..... 271/10.12
6,092,803 A * 7/2000 Munenaka ..... 271/242
6,397,035 B2 * 5/2002 Kataoka et al. ..... 399/388
6,832,548 B2 * 12/2004 Asai et al. ..... 101/118
7,243,917 B2 * 7/2007 Knierim et al. ..... 271/228
7,310,108 B2 * 12/2007 Moore ..... 347/264
7,426,353 B1 * 9/2008 Sakakibara ..... 399/68
7,690,651 B2 * 4/2010 Kubochi ..... 271/265.01
2001/0014235 A1 * 8/2001 Ando et al. ..... 399/395
2004/0251613 A1 12/2004 Quesnel
2005/0230906 A1 10/2005 Loiselle
2006/0051145 A1 * 3/2006 Ubayashi ..... 399/395

FOREIGN PATENT DOCUMENTS

JP 6-72585 A 3/1994

* cited by examiner

*Primary Examiner* — Anthony H. Nguyen

(74) *Attorney, Agent, or Firm* — Holtz, Holtz, Goodman & Chick, P.C.

(57) ABSTRACT

In an image forming apparatus having a registration roller that aligns the leading edge of the sheet and feeds it to the image forming section, a plurality of loop forming rollers that convey the sheet, and a loop forming space for forming a loop in the sheet are placed on the upstream side of the registration roller, and a plurality of loop amount detecting sensors that detect the amount of loop are provided, and the image forming apparatus has the feature that it is provided with a mechanism and a control device for varying the rotational speeds of said plurality of loop forming rollers individually and separately, wherein the loop amounts in a cross-section of the sheet along the sub-scanning direction are adjusted to be at a prescribed value.

7 Claims, 3 Drawing Sheets

IMAGE FORMING APPARATUS

This application is based on Japanese Patent Application No. 2006-149481 filed on May 30, 2006 in Japanese Patent Office, the entire content of which is hereby incorporated by reference.

BACKGROUND OF THE INVENTION

The present invention relates to image forming apparatuses such as copying machines, printer, fax machines and the like of the electro-photographic method, and in particular, to image forming apparatuses having a control device that can control the sheet conveying speed in the loop forming space on the upstream side of the registration device.

The registration roller of an image forming apparatus conventionally has a function of matching the timing of the sheet with the image and, at the same time, has a function of skew correction that absorbs the sheet skew generated during sheet feeding or in the conveying path. After the leading edge of the sheet is aligned by making the sheet strike against the registration roller whose drive is stopped, a bend (a loop) in the sheet in the up-down direction is generated by the sheet being conveyed for a specific time period by a loop forming roller positioned on the upstream side of the registration roller while the drive of the registration roller is stopped, and the correction of sheet skew is done by absorbing the difference between the conveyance direction towards the downstream side of the registration roller and the conveyance direction including the skew on the upstream side of the registration roller.

However, since elastic materials such as rubber are used for the registration roller and the loop forming rollers, there was the problem that, while the skew of a sheet which is long in the conveying direction is being corrected, the loop is consumed due to the distortion of the elastic material, and the ability to correct skew of the sheet is lost.

In order to solve this problem, a proposal has been made to provide a mechanism that detects the amount of loop and adjusts the speed of the feeding section that has the loop forming roller (see, for example, Patent Document 1).

However, in the above proposed mechanism, a sheet (hereinafter, also called a transfer material) that has been fed in a skewed manner gets its orientation changed in the loop forming space, the amount of loop in a direction perpendicular to the conveying direction, that is in the main scanning direction, cannot maintain uniformity. Because of this, even if the amount of loop is detected to be appropriate at a certain location in the main scanning direction, there is the possibility that the loop may not be present at one of the ends. If the amount of feed is increased uniformly so that a larger loop amount is formed considering the above, there will be problems such as buckling of the sheet or sheet folding due to excessive sheet feeding at an end where there is a larger amount of loop.

Patent Document 1: Unexamined Japanese Patent Application Publication No. Hei 6-72585.

SUMMARY

One aspect of the present invention is as follows.

In an image forming apparatus that forms images on sheets, an image forming apparatus having the feature that it has a registration device that sends sheets to the image forming section after aligning the leading edges of the sheets, a plurality of loop forming devices that are on the upstream side of said registration device and that form loops in the sheet between the said registration device and them, a plurality of loop amount detecting devices which are placed between said registration device and said loop forming devices and which detect the amount of loop of the sheet at a plurality of locations in a direction perpendicular to the sheet conveying direction, and a control device that controls individually the sheet conveyance speed of each of said plurality of loop forming devices based on the results of detection of each of said plurality of loop amount detecting devices.

DETAILED DESCRIPTION OF THE PREFERRED EMBODIMENT

An image forming apparatus of the present invention will be described first based on FIG. 1.

The terms and words used in this specification for description of the present embodiment of the invention do not limit the technical scope.

Figure 1:
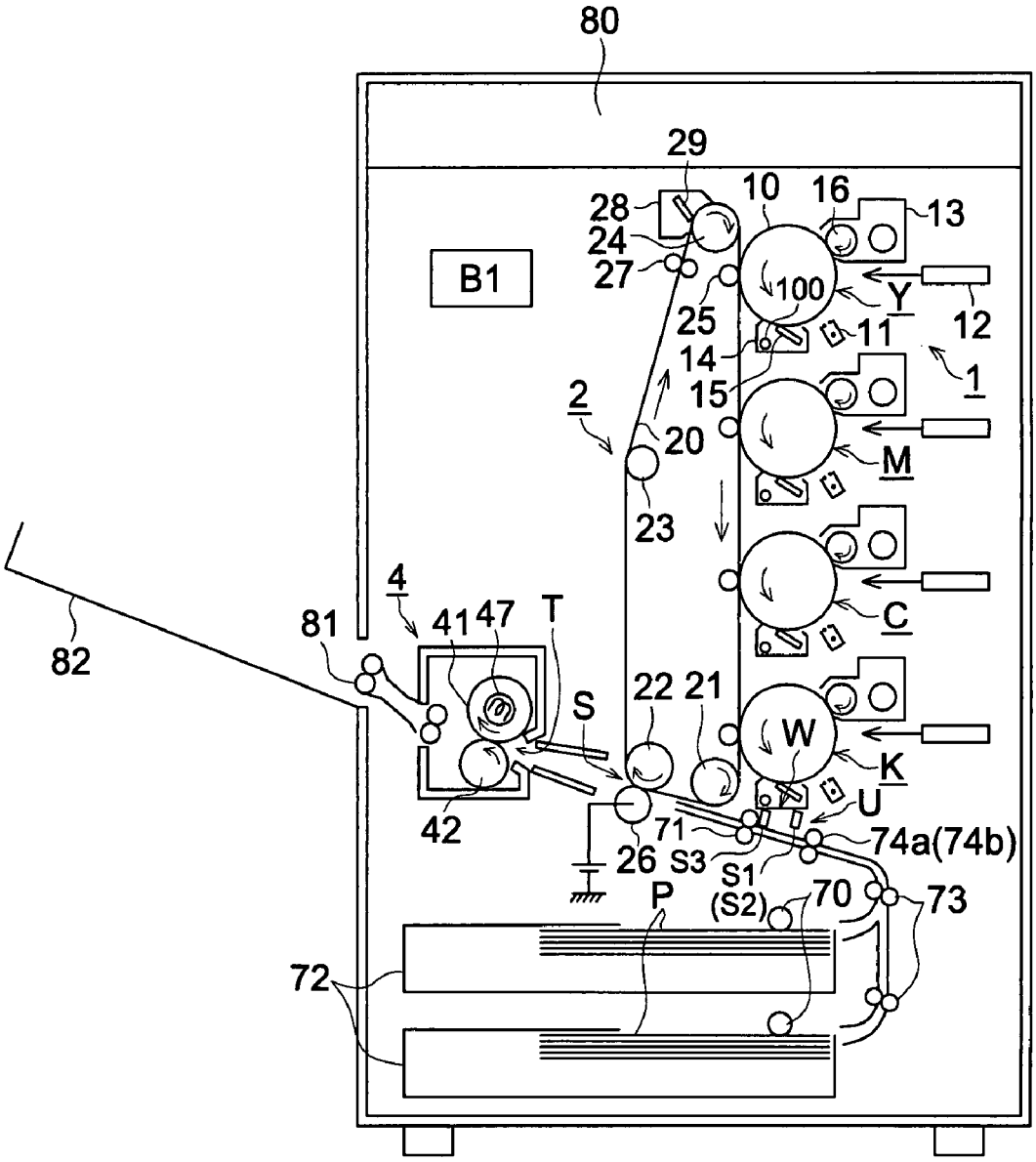
FIG. 1 is a schematic diagram showing an example of the overall configuration of an image forming apparatus.

FIG. 1 is a schematic diagram showing an example of the entire structure of an image forming apparatus.

In FIG. 1, the image forming apparatus includes photosensitive drums 10, scorotron chargers 11 as a charging device, writing units 12 as digital type exposure writing devices, developing units 13 as developing devices, cleaning devices 14 for cleaning the surface of the photosensitive drums 10, cleaning blades 15 for cleaning photosensitive drum 10, and a toner scraped down with the cleaning blade 15 is conveyed by a conveyance screw 100 from cleaning device 14 to an unillustrated disposal box to be disposed. The image forming apparatus further includes developing sleeves 16 and an intermediate transfer belt 20 as an intermediate transfer body.

Each of four groups of an image forming device 1 includes the photosensitive drum 10, scorotron charger 11, developing unit 13, cleaning device 14, and others. The image forming device 1 has the same mechanical structures for respective colors. In FIG. 1, therefore, reference symbols are given only to elements of the structure for Y (yellow), while reference symbols for elements of structures for M (magenta), C (cyan) and K (black) are omitted.

A developing unit 13 has a cylindrical developing sleeve 16 formed of nonmagnetic stainless steel or aluminum material, which rotates in the opposite direction as the photosensitive drum 10 while keeping a predetermined distance from the circumferential surface of a photosensitive drum 10.

The image forming unit 1 for the respective colors are disposed in the order of Y, M, C and K along the running direction of the intermediate transfer belt 20. Each photosensitive drum 10 is in contact with and pressed on the surface of the intermediate transfer belt 20 by a primary transfer roller 25, and rotates in the same direction and at the same linear speed as the intermediate transfer belt 20 at the press contact point.

The intermediate transfer belt 20 is supported with tension by a driving roller 21, a grounding roller 22, a tension roller 23, a discharging roller 27, and a driven roller 24, and an intermediate transfer belt unit 2 is constituted of these rollers and the intermediate transfer belt 20, the primary transfer rollers 25, a cleaning device 28, and others. Further, said grounding roller (backup roller) 22 is a conductive aluminum roller, having its aluminum surface exposed as it is, and is grounded.

Each photosensitive drum 10 is produced in such a manner that the outer surface of a cylindrical metallic body made of, for example, aluminum is formed with a conductive layer, an a-Si layer or a photosensitive layer such as organic photoconductor (OPC), and rotates counterclockwise, as shown in FIG. 1 with an arrow, wherein the conductive layer is grounded.

Electrical signals corresponding to image data from the reading device 80 are converted into optical signals by an image forming laser to be projected onto a photosensitive drum 10 by the writing unit 12.

The travel of the intermediate transfer belt 20 is made by rotation of the driving roller 21 that is driven by a driving motor, not shown. The material of intermediate transfer belt 20 is an endless belt with a volume resistivity of $10^6$ to $10^{12}$ Ω·cm. The material of this intermediate transfer belt 20 is a seamless belt with a two-layer structure with a fluorine coating of a thickness of 5 to 50 μm made on the outside of the film base, preferably as a toner filming prevention layer. The film base is semiconductive, of a thickness of 0.04 to 0.10 mm and produced by dispersing conductive material on an engineering plastic material, such as denatured polyimide, heat curing polyimide, an ethylene tetrafluoroethylene copolymer, polyvinylidene fluoride, and a nylon alloy. As the base of the belt, apart from this, it is also possible to use a semiconductive rubber belt of thickness of 0.5 to 2.0 mm with a conductive material dispersed in silicone rubber or urethane rubber.

A DC voltage with a polarity opposite to that of the toner is applied to the primary transfer roller 25, and the intermediate transfer belt 20 is pressed against the photosensitive drum 10 from the inside of the belt by a pressure contacting and pressure contact releasing mechanism not shown in the figure, and at the nipping portion S formed by the intermediate transfer belt 20 and the grounding roller 22, the toner image formed on the intermediate transfer belt 20 is again transferred (secondary transfer) onto the transfer material P.

Here the numeric symbol 26 refers to a secondary transfer roller which is a secondary transfer device, and presses against the grounding roller 22 via the transfer material P by a pressure contacting and pressure contact releasing mechanism not shown in the figure, and has a function of carrying out secondary transfer of the toner image formed on the intermediate transfer belt onto the transfer material P. Further, the secondary transfer roller 26, is made of a conductive solid rubber whose surface is covered with a coated layer, and a bias voltage with a polarity opposite to that of the toner is applied to it during transfer (or else, a voltage with the same polarity as that of the toner can be applied to the grounding roller 22 and the secondary transfer roller 26 can be grounded,)

An AC voltage superimposed on a DC voltage with the same polarity as or with the opposite polarity to that of the toner is applied to the discharging roller 27, and hence, after the toner image is transferred onto the transfer material P, the electric charge on the toner remaining on the intermediate transfer belt 20 is weakened.

The numeric symbol 4 refers to a fixing unit which has a heating roller 41 and a pressure contacting roller 42.

Said heating roller 41 has a cylindrical shape, is formed out of thin aluminum plate, and has a halogen heater 47 that heats it up to a prescribed temperature from the inside. The temperature is detected and controlled by a contacting type temperature sensor that is placed in said heating roller 41 and that is not shown in the figure.

Further, the numeral 70 indicates a sheet feeding roller, 71 is a registration roller as a registration device, 72 is a sheet cassette, 73 is a conveyance roller, 74*a* and 74*b* are loop forming rollers as a loop forming device related to the present invention. The details of loop formation in the loop forming space U are described later. Also, the numeral 81 indicates a sheet discharge roller that discharges the transfer material, on which a toner has been fixed, to the sheet discharge tray 82.

The control section B1 as the control device carries out image forming process control, fixing temperature control, transfer material conveyance control, and toner density control.

Next, the image forming process is explained based on FIG. 1.

Simultaneously with the starting of image recording, the photosensitive drum 10 for the color signal Y is started to rotate in the counterclockwise direction shown by the arrow due to the starting of rotation by a photosensitive drum drive motor not shown in the figure, and at the same time, due to the charging action of the scorotron charger 11 the application of voltage to the photosensitive drum 10 is started.

After a voltage is applied to the photosensitive drum 10, the writing of the image corresponding to the image data of Y is started by the writing unit 12, and an electrostatic latent image corresponding to the color Y image of the original document image is formed on the surface of the photosensitive drum 10.

Said electrostatic latent image is conducted reversal development in a non-contacting manner by the developing unit 13 of color Y, and a toner image is formed on the photosensitive drum 10 in accordance with the rotation of the photosensitive drum 10.

The color Y toner image formed on said photosensitive drum 10 is primary transferred onto the intermediate transfer belt 20 due to the action of the primary transfer roller 25 for Y.

Thereafter, any residual toner on said photosensitive drum 10 is removed by the blade 15 of the cleaning device 14.

In a similar manner, the image corresponding to the image data of the color signal of M (magenta), that is image data of M, is written by the writing unit 12, and an electrostatic latent image of M corresponding to the color M image of the original document image is formed on the surface of the photosensitive drum 10. Said electrostatic latent image is converted into a toner image of color M on the surface of the photosensitive drum 10 by the developing unit 13 of color M, and synchronization is achieved with said Y toner image on the intermediate transfer belt 20 and the color M toner image is superimposed over said Y toner image by the primary transfer roller 25 of the color M. After transfer, any residual M toner on the photosensitive drum 10 is removed by the blade 15 of the cleaning device 14.

By a similar process, synchronization is achieved with said Y and M superimposed toner images on the intermediate transfer belt 10 and the color C (cyan) toner image is superimposed over said Y and M superimposed toner images by the primary transfer roller 25 of the color C. Next, synchronization is achieved with the superimposed Y, M, and C toner images and the color K (black) toner image is superimposed over said superimposed Y, M, and C toner images by the primary transfer roller 25 of the color K to form superimposed Y, M, C and K toner images. After transfer, any residual K toner on the photosensitive drum 10 is removed by the blade 15 of the cleaning device 14.

The intermediate transfer belt 20 carrying the superimposed toner images is conveyed in the clockwise direction as shown by the arrow, the transfer material P is fed from the sheet cassette 72 by the sheet feeding roller 70, passed through the conveyance roller 73 and the loop forming roller 74*a* (74*b*), sent to the registration roller 71 and stopped temporarily. A loop is formed in the loop forming space U, a skew in the sheet is corrected, and also synchronization is achieved with the superimposed image on the intermediate transfer belt 20. Thereafter, due to restarting of the drive of said registration roller 71 the transfer material P is fed to the nipping portion S of the transfer area, and the superimposed toner images on the intermediate transfer belt 20 are secondary transferred all together onto the transfer material P by the secondary transfer roller 26 (which is in a state of pressure contact with the intermediate transfer belt 20) to which a DC voltage with a polarity opposite to that of the toner has been applied.

After that, the intermediate transfer belt 20 travels further, the electric charge on the residual toner is weakened by the discharging roller 27, the residual toner on the belt is cleaned in the cleaning device 28 by the blade 29 of the cleaning device 28, and the next image formation cycle is started.

The scraped off toner is accumulated in the cleaning device 28, conveyed in the axial direction (in the direction from the front surface towards the back surface of the sheet in FIG. 1) by the rotation of a conveying screw not shown in the figure, and is accumulated in a storage box via a disposal tube.

The transfer material P onto which said superimposed toner image has been transferred is sent to the fixing unit 4, gripped by the nipping portion T of the heating roller 41 and the pressure roller 42, and is fixed by applying pressure. The transfer material P on which the toner image has been fixed is conveyed to the sheet discharge tray 82 by the sheet discharge roller 81.

Figure 2:
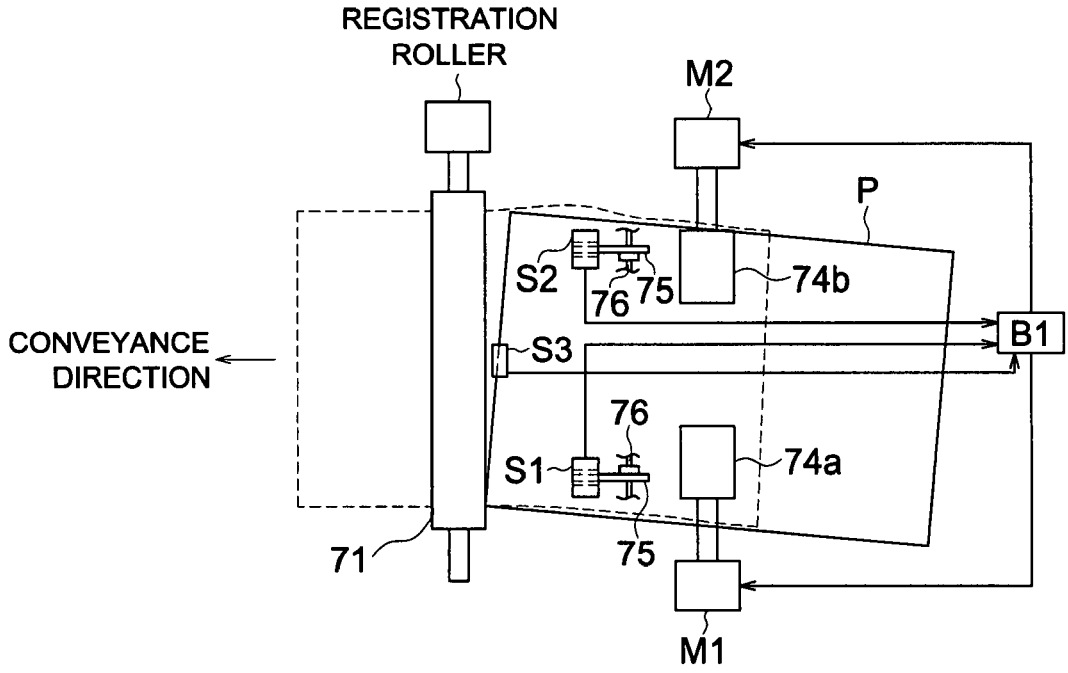
FIG. 2 is a plan view diagram of the loop forming space section of FIG. 1 as viewed from the direction of the arrow W and its cross-sectional view diagram.
Figure 2:
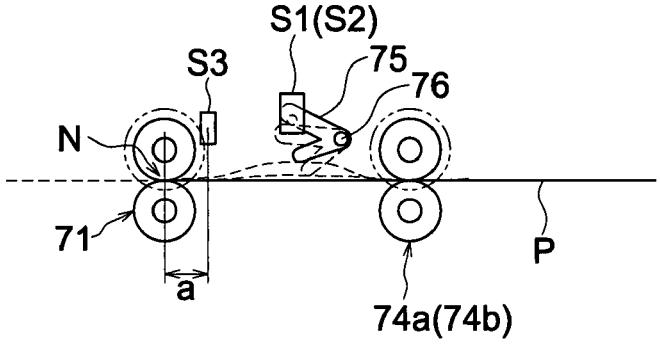

Next, the features of loop formation which is related to the present invention are described based on FIG. 2.

FIG. 2 is a plan view diagram of the loop forming space of FIG. 1 as viewed from the direction of the arrow W and its cross-sectional view diagram.

As has been explained above, the sheet that is fed in a skewed state to the registration roller is stopped temporarily when its leading edge strikes against the registration roller. Therefore, the leading edge side of the sheet from the loop forming roller up to the registration roller gets its orientation changed thereby correcting the skew of the sheet. However, since the part of the sheet that is being gripped and conveyed by the loop forming rollers 74*a* and 74*b* is still skewed, the amount of sheet which has been conveyed from the loop forming rollers towards the registration roller is not uniform along the width direction of the sheet. Therefore, uniformity in the amount of loop is not maintained over the entire width along the main scanning direction of the sheet (a direction perpendicular to the conveying direction). Because of this, even it is detected that the amount of loop of the sheet is appropriate at a certain point along the main scanning direction, it is possible that the loop may disappear at one of the edges of the sheet during re-conveying after the temporary stop. If the amount of feed is made uniformly larger than the above state along the entire width considering the above problem so that the amount of loop is made larger, there may be a problem that buckling or folding of the sheet occurs at the edge where there is a larger loop amount than the other edge because of excessive feeding of the sheet. If the loop disappears in a part of the sheet during re-conveying after the temporary stop, only the side of the sheet where the loop has disappeared may slip under the registration roller, and the sheet may become skewed again. In addition, there may be fluctuations in the load on the sheet, thereby causing disorder in the transferred image.

In FIG. 2(*a*), the loop forming rollers 74*a* and 74*b* are directly coupled to the loop motors M1 and M2 that are separate drive sources. These loop forming rollers 74*a* and 74*b* have their speeds controlled individually by the control section B1. The registration roller 71 keeps stopped temporarily in order to achieve synchronization between the toner image on the intermediate transfer belt and the transfer material.

The transfer material P conveyed in the skewed state reaches the registration roller 71, and then said loop forming rollers 74*a* and 74*b* continue to rotate for prescribed period of time. Owing to this, not only the leading edge of the transfer sheet P is corrected to become parallel to the nipping portion S but also the formation of a loop is started in the loop forming space U, and further the amount of loop is measured by the loop amount detecting sensors S1 and S2 as a loop amount detecting device. Further, these loop amount detecting sensors S1 and S2 are of the light transmission type and become ON or OFF according to a prescribed loop amount by an actuator 75 that rotates with the supporting shaft 76 as a pivot, and their signals are transmitted to the control section B1 which is a control device.

In FIG. 2(*b*), the loop amount detecting sensors S1 and S2 become OFF when the actuator 75 is in the position indicated by the continuous lines and become ON when the actuator is in the position indicated by the broken lines. Further, a sheet detecting sensor S3 is provided immediately before the registration roller 71 on the upstream side (at the central part of the main scanning direction of the transfer material). In order to prepare the initial loop, this controls the stopping timing so as to stop the loop motors when a prescribed amount has been conveyed after the leading edge of the transfer sheet P has struck against the stopped registration roller.

In order to control the initial loop amount, it is also possible not to use the sheet detecting sensor S3, but to use the loop amount detecting sensors S1 and S2. In other words, if the respective loop rollers are stopped when S1 or S2 detects the prescribed loop amount, it is possible to obtain an appropriate loop amount from the initial condition over the entire width of the transfer material P. However, if the transfer material is curled, or if a stiff sheet such as a thick sheet is used, the sensors S1 or S2 may be activated before the leading edge of the transfer sheet P reaches the nipping portion of the registration roller and stops the loop motors. In other words, there is a possibility of wrong operation due to wrong detection. Because of this, the sheet detecting sensor S3 is provided apart from the sensors S1 and s2.

After the loop amount detection is completed, the registration roller starts rotating again in synchronization with the toner image, and the control section B1 controls the loop motors M1 and M2 so that the loop forming rollers 74*a* and 74*b* are rotated at conveyance speeds according to the result of detection of the loop amount detecting sensors S1 and S2. In other words, while the transfer material is being conveyed by the registration roller 71, control is carried out by providing a speed difference between the loop forming rollers 74*a* and 74*b* so that the loop amount is made uniform. Each of the loop forming rollers is controlled individually so that, at least, the loop is formed over the entire width of the transfer sheet along a direction perpendicular to the conveyance direction, that is, so that there is no part where there is no loop formation. The control is made so as to prevent the case where the transfer material whose loop has disappeared is pulled by the registration roller 71.

In other words, if the linear speed of the registration roller is taken as V1, and the speeds of the loop forming rollers 74*a* and 74*b* are taken as V2 or V3, the relationship between the outputs of the loop amount detecting sensors S1 and S2 when they are ON or OFF and the roller linear speeds V2 and V3 generated by the loop motors M1 and M2 is as shown in Table 1. The relationships among the drive speeds satisfy the condition V2<V1<V3.

TABLE 1

| Output of loop amount detecting sensor S1 | Output of loop amount detecting sensor S2 | Linear speed of loop formation roller 74a | Linear speed of loop formation roller 74b |
|---|---|---|---|
| ON | ON | V3 | V3 |
| OFF | ON | V2 | V3 |
| ON | OFF | V3 | V2 |
| OFF | OFF | V2 | V2 |

In the following, a preferred embodiment of the present invention is explained based on Table 1 and a time chart.

Figure 3:
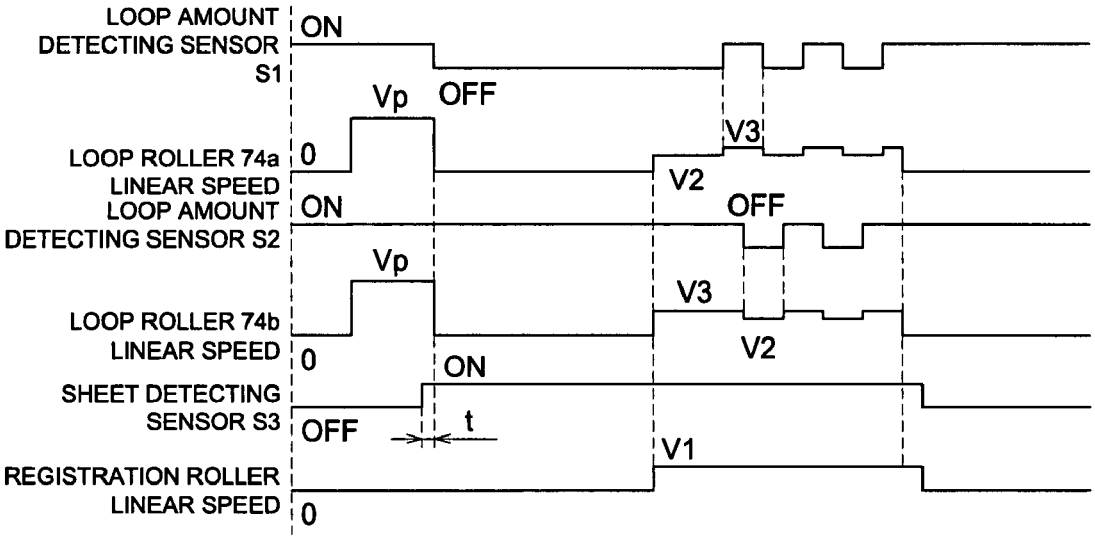
FIG. 3 is a time chart for explaining the conveyance process of the transfer material in the loop forming space.

FIG. 3 is a time chart for explaining the conveyance process of the transfer material in the loop forming space.

In FIGS. 1, 2, and 3, (1) the transfer material fed from the sheet cassette 72 passes through the conveyance rollers 73, and reaches the loop forming rollers 74*a* and 74*b*. Before the leading edge of the transfer sheet arrives at these loop forming rollers 74*a* and 74*b* they are make to rotate in an idle rotation at a sheet feeding linear speed of Vp (mm/sec), thereby making the gripping and conveying of the transfer material take place smoothly. (2) The leading edge of the transfer sheet conveyed at a sheet feeding linear speed of Vp passes through the loop forming space U, and arrives at the sheet detecting sensor S3 (at the central part in the main scanning direction of the transfer material). After this arrival of the transfer material has been detected, the loop forming rollers 74*a* and 74*b* rotate for a prescribed duration t (seconds) of time and then stop. This time t determines the amount of loop, from the time the central part of the transfer sheet arrives at the sheet detecting sensor S3 until the loop forming rollers 74*a* and 74*b* stop rotating. In other words, when the distance from the sheet detecting sensor S3 to the nipping portion N (central part) of the registration roller 71 is taken as "a" (mm), since the sheet feeding linear speed is Vp, the instant of time when the central part of the leading edge of the transfer material enters the nipping portion of the registration roller 71 is a/Vp (seconds) after said sheet detecting sensor S3 has detected the transfer sheet. In order for the transfer sheet to form a loop, it is necessary to convey it further by "b" (mm), and this time duration becomes (a+b)/Vp. (3) In the process of feeding by "b" (mm) and forming a loop, only the loop amount detecting sensor S1 detects that the prescribed loop amount has been exceeded, and the output of the loop amount detecting sensor S1 becomes OFF. This means that the transfer material is skewed so that the transfer material of the loop formation roller 74*a* side has arrived earlier than that of the loop formation roller 74*b* side, and consequently this indicates that the loop has been formed with a larger loop amount on the loop forming roller 74*a* side. In addition, the leading edge of the transfer material P has struck against the nipping portion N and its skew is corrected. (4) At this point of time, the loop forming rollers 74*a* and 74*b* are stopped. After that, the drive of the registration roller 71 is started at a linear speed of V1 (the image formation speed) so as to match with the timing of the toner image on the intermediate transfer belt 20. In synchronization with this, the drives of the loop formation rollers 74*a* and 74*b* are started. The loop formation roller 74*a* at which a larger amount of loop has been formed after the transfer material has struck against the nipping portion N is driven at a somewhat lower speed V2 than the linear speed V1, and the loop amount starts to decrease gradually. On the other hand, the drive of the loop formation roller 74*b* is made at a somewhat higher speed V3 than the linear speed V1, and the amount of loop starts to increase gradually. (5) As a result of this, when the amount of loop of the loop forming roller 74*b* reaches the prescribed loop amount, its drive speed is reduced from V3 to V2. In addition, the drive speed of the loop forming roller 74*a* is increased from V2 to V3 as the amount of loop has become below the prescribed loop amount. Therefore, this loop amount adjustment is carried out repeatedly using the respective loop forming rollers and loop amount detectors, and hence it becomes possible to maintain an appropriate loop amount. (6) When the transfer material passes beyond the sheet detecting sensor S3 and is no longer detected by it, the loop forming rollers 74*a* and 74*b* stop rotating. After a prescribed time duration subsequent to that (at least equal to a/Vp (sec) or more), even the registration roller 71 stops rotating, and preparation is made for the next transfer material to be conveyed.

Here, in the present preferred embodiment, by controlling the loop forming rollers 74*a* and 74*b* at a linear speed V2 lower than the linear speed V1 of the registration roller or at a linear speed V3 higher than the linear speed V1 of the registration roller, a very high accuracy is being obtained. However, as a method of simplifying the control while reducing the accuracy slightly, for example, there is also a method of controlling the speed of the loop forming roller to a speed faster than the linear speed of the registration roller 71, on the side at which the loop is not detected, that is, on the side in which the sheet feed has been delayed, and of controlling the speed of the loop forming roller on the other side to be the same as the linear speed of the registration roller 71.

By the control device carrying out, based on each of the results of detection by a plurality of loop amount detecting devices, control of the respective sheet conveyance speeds of the corresponding plurality of loop forming devices, it is possible to form loops in the sheet with an appropriate loop amount over the entire width of the sheet along a direction perpendicular to the sheet conveyance direction, and since the loop does not become smaller than the amount necessary for correcting the sheet skew, it is possible to carry out stable correction of sheet skew even if the sheet has a long length in the direction of conveying the sheet.

What is claimed is:

1. An image forming apparatus comprising:

an image forming section for forming an image on a sheet;

a registration roller for sending a sheet to the image forming section in a sheet conveyance direction after correcting a skew of the sheet by allowing a leading edge of the sheet to come in contact with the registration roller and by stopping the leading edge of the sheet temporarily;

a plurality of loop forming devices which are on an upstream side of the registration roller and which convey a sheet to the registration roller and form a loop of the sheet between the registration roller and the plurality of loop forming devices;

a plurality of loop amount detecting devices which are placed between the registration roller and the plurality of loop forming devices and which detect an amount of the loop of the sheet at a plurality of locations across a width of the sheet in a direction perpendicular to the sheet conveyance direction; and a control device which (i) performs control to temporarily stop the leading edge of the sheet by allowing the leading edge of the sheet to hit the registration roller while the registration roller is stopped and to form a loop between the plurality of loop forming devices and the registration roller to correct the skew of the sheet, and (ii) then performs control to start to convey the sheet by the plurality of loop forming devices and the registration roller simultaneously;

wherein the control device individually controls a sheet conveyance speed of each of the plurality of loop forming devices to provide a difference in the sheet conveyance speed between the plurality of loop forming devices based on a result of detection of each of the plurality of loop amount detecting devices for the sheet being conveyed so that an amount of the loop is made and kept uniform across a full width of the sheet in a direction perpendicular to the sheet conveyance direction while the registration roller is conveying the sheet.

2. The image forming apparatus of claim 1, wherein the registration roller is adapted to be used to control a conveyance timing of the sheet to the image forming section so as to match an image position with the sheet.

3. The image forming apparatus of claim 1, wherein the loop between the registration roller and the plurality of loop forming devices is formed by bringing the registration roller and the plurality of loop forming devices into contact with the sheet simultaneously.

4. The image forming apparatus of claim 1, wherein when forming the loop between the plurality of loop forming devices and the registration roller, the control device temporarily stops the plurality of loop forming devices from conveying the sheet when a prescribed time has elapsed after the leading edge of the sheet comes into contact with the registration roller.

5. The image forming apparatus of claim 1, wherein the control device performs control so that the loop amount detected by the plurality of loop amount detecting devices is maintained at a prescribed amount.

6. The image forming apparatus of claim 5, wherein the plurality of loop forming devices comprise a first loop forming device and a second loop forming device;

wherein the plurality of loop amount detecting devices comprise a first loop amount detecting device and a second loop amount detecting device arranged such that the first loop amount detecting device is located closer to the first loop forming device than to the second loop forming device and such that the second loop amount detecting device is located closer to the second loop forming device than to the first loop forming device; and wherein the control device performs control so that the sheet conveyance speed of the first loop forming device is slower than a conveyance speed of the registration roller when the loop amount detected by the first loop amount detecting device is greater than the prescribed loop amount, and the control device performs control so that the sheet conveyance speed of the first loop forming device is faster than the conveyance speed of the registration roller when the loop amount detected by the first loop amount detecting device is less than the prescribed loop amount.

7. The image forming apparatus of claim 6, wherein the control device repeatedly performs loop amount adjustment control to adjust the loop amount to the prescribed loop amount.

* * * * *